US006142327A

United States Patent [19]

Riggio et al.

[11] Patent Number: 6,142,327

[45] Date of Patent: Nov. 7, 2000

[54] DOUBLE ENDED CARRIER

[75] Inventors: Joseph M. Riggio, Evans, Ga.; Charles C. Redmon, Anniston, Ala.

[73] Assignee: United Defense, L.P., Arlington, Va.

[21] Appl. No.: 08/959,597

[22] Filed: Oct. 29, 1997

[51] Int. Cl.[7] ..... B65D 19/08

[52] U.S. Cl. ..... 220/1.5; 206/596; 206/598

[58] Field of Search ..... 220/1.5; 206/596, 206/598, 595

[56] References Cited

U.S. PATENT DOCUMENTS

| | | | |
|---|---|---|---|
| 209,037 | 10/1878 | Gardner . | |
| 4,571,143 | 2/1986 | Hellerich . | |
| 4,662,669 | 5/1987 | Erickson et al. . | |
| 5,947,312 | 9/1999 | Elstone | 220/1.5 |

FOREIGN PATENT DOCUMENTS

| | | | |
|---|---|---|---|
| 0178136 | 4/1986 | European Pat. Off. . | |
| 2044237 | 5/1971 | Germany | 206/598 |

*Primary Examiner*—Stephen Castellano
*Attorney, Agent, or Firm*—Ronald C. Kamp

[57] ABSTRACT

The invention provides a container for products free from moisture, such as potassium in an emulsified state. The container has sloping sides to facilitate the emptying of the container. The container is surrounded by a frame, which allows the stacking of several containers. The frame has forklift guides to facilitate movement by forklifts. The frame also has hoist lugs to facilitate movement by hoists. An assist vent valve is used to assist the filling and emptying of the container. The assist vent valve is removable, to allow the replacement of the assist vent valve, when an assist vent valve is damaged, or clogged.

1 Claim, 1 Drawing Sheet

DOUBLE ENDED CARRIER

BACKGROUND OF THE INVENTION

In the prior art, containers for carrying substances free from moisture, such as potassium in an emulsified state, were excessively heavy and expensive. These containers also had problems with being emptied and were hard to handle and stack. Prior art containers were difficult to turn over for emptying, thus requiring the emptying of the container while the opening in the container remained on top of the container.

SUMMARY OF THE INVENTION

It is an object of the invention to provide a container that can carry substances such as potassium in an emulsified state free from moisture.

It is an object of the invention to provide a light weight container that is easy to handle, stackable, easy to empty and is not expensive.

The present invention provides a container that is not excessively heavy, and is stackable and easy to handle, and easy to empty.

The present invention is easier to flip, allowing the invention to be emptied by flipping the container so that the opening is on the bottom and allowing gravity to remove the contents of the container.

DESCRIPTION OF THE PREFERRED EMBODIMENTS

Figure 1:
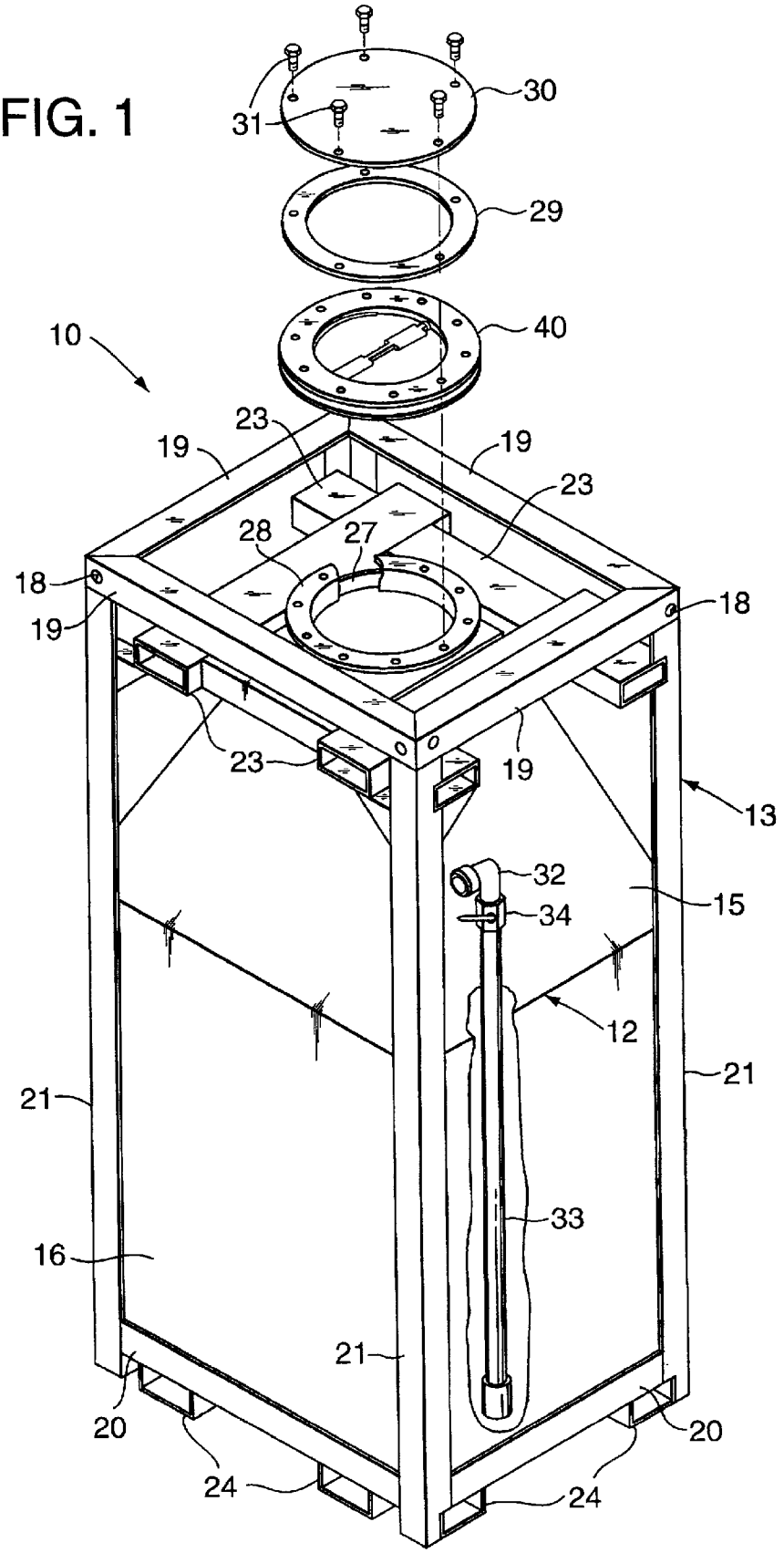
FIG. 1 is a perspective cut away view of an inventive carrier.

In the double ended carrier 10 illustrated in FIG. 1, there is a container 12 and frame 13.

The container 12 is an aluminum unit which has a top portion 15 and a bottom portion 16.

The frame 13 comprises a top frame 19, which is a square formed by four pieces of angle iron, a bottom frame 20, which is a square formed by four pieces of angle iron, and side pieces 21, which are four pieces of angle irons extending between corners of the top frame 19 and the bottom frame 20, with the side pieces 21 extending slightly beyond the bottom frame 20. Hoist lugs 18 are placed in all four sides of the top frame 19.

Two pairs of crossing top forklift guides 23 are mechanically connected to the side pieces 21, between the top frame 19 and the top portion 15. Two pairs of crossing bottom forklift guides 24 are mechanically connected to the side pieces 21 and adjacent to the bottom frame 20.

The top portion 15 is in the form of a truncated four sided pyramid, with the largest base of the truncated pyramid connected to the bottom portion 16 and with the smallest base of the truncated pyramid connected to a circular neck 27. The sloping sides of the top portion 15 are at a 65–70 degree angle and are straight for enhanced flow control and easy discharge. The neck 27 is connected between the smallest base of the top portion 15 and a circular mounting flange 28. The inner diameter of the neck 27 and the mounting flange 28 is 16 inches, creating a 16 inch opening in the container 12. Preferably the diameter of the opening is between 10 and 25 inches. A main valve 40, gasket 29, and cover 30 are bolted to the mounting flange 28 with bolts 31 to close the opening during shipping and handling. The main valve 40 facilitates filling and dispensing of the containerized material. The mounting flange 28 is placed between the top fork lift guides 23 and the top frame 19.

The bottom portion 16 is a rectangular box shape and extends between the side pieces 21, the bottom frame 20, and the largest base of the truncated pyramid forming the top portion 15.

A threaded discharge assist vent pipe 32 is connected through the top portion 15 of the container 12. The discharge assist vent pipe is connected to an interior pipe 33, which extends to a part of the interior of the bottom portion 16 that is furthest away from the top portion 15. The assist vent pipe 32 is opened and closed by a vent valve 34.

In operation, the carrier 10 is placed so that the top frame 19 is up. The bottom forklift guides 24 or the top forklift guides 23 may be used to move the carrier 10 with a forklift. A hoist may be connected to the hoist lugs 18, to move and place the carrier 10. The bolts 31, cover 30, and gasket 29 are removed from the main valve 40, and the main valve 40 is opened to open the container 12. The vent valve 34 may be opened to facilitate the filling of the container 12. The container 12 is filled with the substance to be carried, such as potassium in an emulsified state free from moisture. The main valve 40 is closed, and the gasket 29 and cover 30 are bolted to the mounting flange 28, to close the opening. The vent valve 34 is closed.

The carrier 10 is then moved using a forklift using the top or bottom forklift guides 23, 24 or using a hoist using the hoist lugs 18. The frame 13 protects the container 12 and the cover 30 and allows the stacking of many carriers 10.

To empty the carrier 10, the vent valve 34 is opened and the cover 30 and gasket 29 are removed. The carrier 10 is placed so that the top frame 19 is the lowest part of the carrier 10. The main valve 40 is opened to allow the emptying of the container 12.

After the container 12 is emptied, the vent valve 34 and the main valve 40 are closed and the cover 30 and gasket 29 are bolted to the main valve 40. The containers 10 may be stacked and returned to the manufacturers to be reused. This eliminates the disposal of substances with hazardous residues.

During the movement of the container 10 the assist vent pipe 32 may be damaged or become plugged. Because the assist vent pipe 32 is threaded, it may be easily removed and replaced with an undamaged assist vent pipe 32.

The resulting light wait container, allows transportation of substances free from moisture such as potassium in an emulsified state. This container meets the United States Department of Transportation standards.

Although the best mode contemplated for carrying out the present invention has been herein shown and described, it will be understood that modification and variation may be made without departing from what is regarded to be the subject matter of the invention.

What is claimed is:

1. An apparatus for the safe transport and handling of materials in an emulsified or liquid state comprising:

a frame comprising:

rectangular-shaped top and bottom frames, with each of said frames defining outer corners; and side pieces extending between and connected to the outer corners of the respective top and bottom frames;

a first pair of parallel tubular members capable of accepting the tines of a fork lift are connected to said side pieces adjacent the said top frame;

a second pair of parallel tubular members capable of accepting the tines of a fork lift are positioned transverse to said first pair of members and secured thereto;

a container having a truncated pyramid-shaped top and a parallelepiped bottom portion connected to the top to form an enclosure;

a circular neck is attached to and mates with said pyramid-shaped top;

a circular mounting flange is secured to said neck;

a valve is secured to said mounting flange for selectively opening and closing;

a cover is removably connected to said flange;

a gasket is interposed between said cover and said valve and functions in conjunction with said cover, when in place, to contain any leakage that may occur through said valve and to prevent the entrance of moisture into said container; and said cover being positioned below said top frame to permit stable stacking of the container.

* * * * *